United States Patent [19]

Chuang et al.

[11] Patent Number: 4,851,317

[45] Date of Patent: Jul. 25, 1989

[54] LAMINAR FLOW TONING STATION HAVING CONDUCTIVE AND NONCONDUCTIVE ELEMENTS THEREIN

[75] Inventors: Thomas C. Chuang, Newark; Kenneth E. Walters, Bear, both of Del.

[73] Assignee: E. I. Du Pont de Nemours and Company, Wilmington, Del.

[21] Appl. No.: 116,498

[22] Filed: Nov. 4, 1987

[51] Int. Cl.[4] ..... G03G 15/10

[52] U.S. Cl. ..... 430/119; 118/662; 118/651

[58] Field of Search ..... 430/119; 118/662, 651

[56] References Cited

U.S. PATENT DOCUMENTS

| | | | |
|---|---|---|---|
| 3,782,818 | 1/1974 | Smith | 430/119 |
| 3,839,071 | 10/1974 | Borelli et al. | 117/37 LE |
| 3,990,394 | 11/1976 | Katakura | 118/651 |
| 4,013,356 | 3/1977 | Bestenreiner et al. | 355/10 |
| 4,044,718 | 8/1977 | Blake et al. | 118/647 |
| 4,172,430 | 10/1979 | Barone | 118/660 |
| 4,193,682 | 3/1980 | Müller et al. | 355/10 |
| 4,208,121 | 6/1980 | Müller | 355/10 |
| 4,236,810 | 12/1980 | Paul | 118/662 |
| 4,286,039 | 8/1981 | Landa et al. | 430/119 |
| 4,373,469 | 2/1983 | Kuge et al. | 430/117 |
| 4,398,818 | 8/1983 | Jeromin et al. | 355/10 |
| 4,480,907 | 11/1984 | Vackier | 355/10 |
| 4,563,080 | 1/1986 | Ottley | 355/10 |

FOREIGN PATENT DOCUMENTS 8002466 11/1980 World Int. Prop. O. .

*Primary Examiner*—John L. Goodrow

[57] ABSTRACT

Apparatus for developing a latent electrostatic image on the image bearing surface of an imaging member using a liquid toner is characterized by a toning station having a toning member therein. The toning member has a conductive and a nonconductive element thereon. The nonconductive element is disposed upstream of the conductive element in the direction of movement along the path of travel of the image bearing surface through the toning station. The conductive element is connected to a bias voltage so that the image is toned first in the absence of a bias followed by toning in the presence of a bias voltage. Laminar toner flow is maintained in the direction of movement of the image bearing surface during the contact of the surface with the toner.

12 Claims, 4 Drawing Sheets

LAMINAR FLOW TONING STATION HAVING CONDUCTIVE AND NONCONDUCTIVE ELEMENTS THEREIN

BACKGROUND OF THE INVENTION

1. Field of the Invention

The present invention relates to electrostatic toning apparatus of the type using a liquid toner and in particular to a toning apparatus which is provided with a toning member that has conductive and nonconductive elements thereon and which forms a laminar flow of toner liquid over the conductive element of the toning member.

2. Description of the Prior Art

In the color proofing industry latent images are typically formed on the surface of a photoconductive imaging member. The images are developed by the application of a liquid toner to the surface. The latent electrostatic image carried on the photoconductive surface may be envisioned as a collection of closely spaced pockets of electrostatic charge. The charges produce associated voltages on the surface of the member. The voltage magnitude determines the toner stack height and the image density in both highlight and shadow dot areas. However, when measured with an electrostatic voltmeter the highlight dots exhibit lower voltage than that of the shadow dots. The charge distribution for each of the edges of the highlight and shadow dots can be represented of a Gaussian distribution. The depiction in FIG. 1A shows a typical voltage representation in a highlight image dot H and a shadow dot S in a latent electrostatic image prior to toning.

It has been found that depending on what kind of half tone generation algorithm is used the average voltage on the smaller highlight image dot H is lower than that on the larger shadow image dot S. Thus, as noted earlier, in FIG. 1A the smaller voltage magnitude represents a latent image of a highlight dot H and the lager voltage magnitude represents a latent image of a shadow dot S.

Toning efficiency is a strong function of the dot voltage. The image quality of a proof is governed by the density of each individual color and each individual half tone dot as it is developed. To enhance the development of the latent image it has been found that the presence of a bias voltage during toning permits the larger shadow dot S to develop to completion faster than the smaller highlight image dot H. As a result, in the presence of a bias voltage during toning, the toner density of the finished shadow dot is substantially greater than that of the highlight dot. This situation is illustrated in FIG. 1B which depicts the toner density distributions for a developed highlight image dot H and a shadow image dot S when development occurs in the presence of a bias voltage.

It is conversely known that toning in a nonbiased environment permits the highlight image dot H to be developed rapidly. However, due to the strong fringe fields around the edges of the shadow image dot S, the latent shadow image dot S cannot be toned to full density in the same nonbias environment. FIG. 1C depicts the density distribution of toner when the highlight image dot H and the shadow image dot S have been toned in the absence of a bias voltage. The toner density distribution in the highlight image dot H is relatively uniform because the field distribution within the highlight image dot H is relatively uniform owing to the small dot size (see FIG. 1A). However, because of the fringe field the shadow image dot cannot be toned to a uniform density across the dot.

Accordingly, in view of the foregoing it is believed advantageous to provide a toning apparatus wherein the latent electrostatic images of both the highlight and the shadow image dots can each be toned to thier full density and to substantially equal densities.

SUMMARY OF THE INVENTION

The present invention relates to a method and to an apparatus for efficiently toning the latent electrostatic image of both highlight and shadow image dots. The invention relates to an electrostatic toning arrangement of the type using a liquid toner. The apparatus includes a reservoir for the liquid toner, an imaging member having an image bearing surface thereon and means for moving the imaging member along a predetermined path of travel past the reservoir. The present invention is equally adapted for use with an imaging member that may be either planar or cylindrical in exterior configuration.

The toning apparatus further includes a toning station having a toning member therein, the toning member being mounted in proximity to the path of travel of the imaging member. The toning member cooperates with the imaging member to define a channel therebetween, the channel being in fluid communication with the reservoir. Means are provided for pumping the liquid toner into the channel and flowing the same over the toning member such that the toner may be brought into contact with the image bearing surface thereby to develop a latent image carried on the same.

In accordance with the present invention the toning apparatus is improved in that the toning member comprises a first and a second element, the first element being positioned upstream from the second element in the direction of movement of the imaging member. The first element is formed of a nonconductive material while the second element is formed of a conductive material. Means are provided for imposing a predetermined bias potential on the conductive element. As the imaging member is moved past the toning member toner in the channel is first brought into toning contact with the image bearing surface in the region of the channel adjacent to the nonconductive element of the toning member. Then the toner in the channel is brought into toning contact with the image bearing surface in the presence of a bias potential only in the region of the channel adjacent the conductive elements of the toning member. In addition, in accordance with the present invention, means are also provided for forming a laminar flow of the toner through the channel and over the conductive element of the toning member. As a result, using the method and apparatus of the present invention, the highlight and the shadow image dots are each toned in the biasing environment that is found most conducive to the development of each.

BRIEF DESCRIPTION OF THE DRAWINGS

The invention will be more fully understood from the following detailed description thereof taken in connection with the accompanying drawings which form a part of this application.

FIG. 1A represents the voltage relationship in a latent electrostatic image for a highlight image dot and for a shadow image dot. FIG. 1B depicts the toner density distributions for developed highlights and shadow image dots when development occurs in the presence of a bias voltage, while FIG. 1C depicts the density distribution of toner when the highlight and the shadow dots have been toned in the absence of a bias voltage.

DETAILED DESCRIPTION OF THE INVENTION

Figures 1A, 1B, 1C:
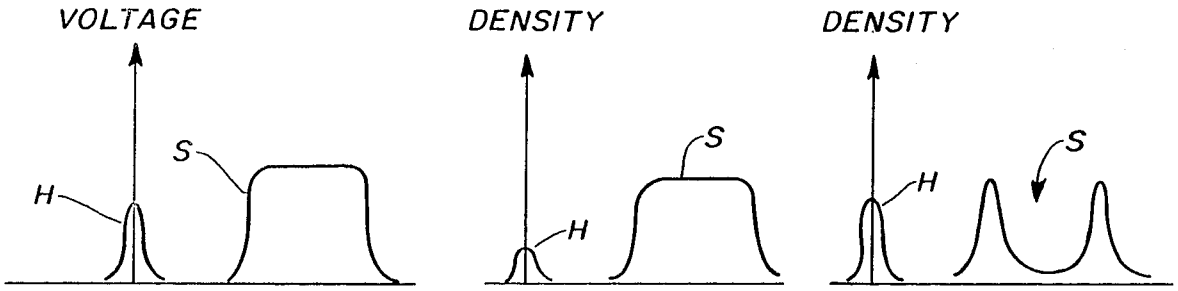
FIGS. 1A, 1B and 1C are graphical depictions of the situation existing in prior art electrostatic toning situations.

Throughout the following detailed description similar reference numerals refer to similar elements in all figures of the drawings.

Figure 2:
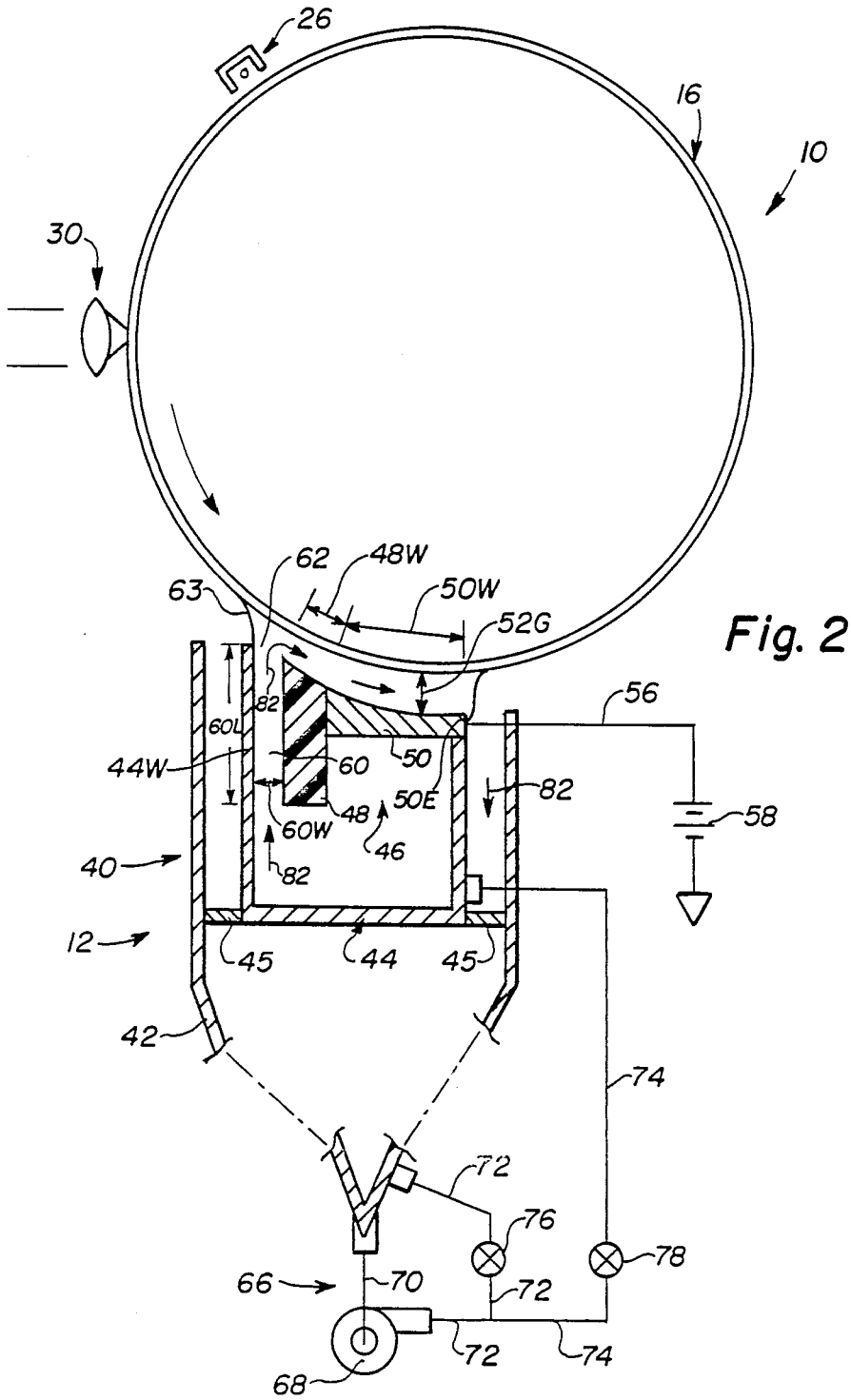
FIG. 2 is a highly stylized diagrammatic representation in side elevation of a toning apparatus having a cylindrical imaging member with which a toning member in accordance with the present invention may be utilized.
Figure 3:
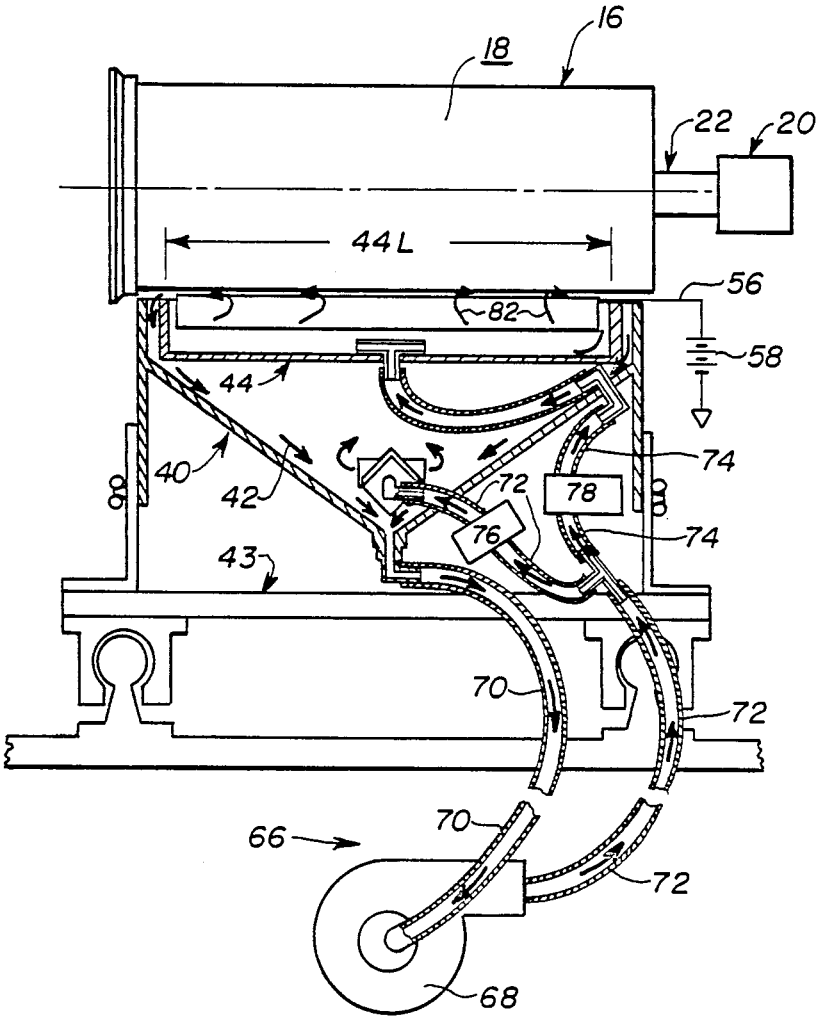
FIG. 3 is a more technically realistic representation of a front elevation view of the toning apparatus as it would appear in the direction of view lines 3—3 of FIG. 2 with portions broken away for clarity.

With reference to FIGS. 2 and 3 shown respectively in side and in front elevation are diagrammatic and more technically realistic representations of an electrostatic toning apparatus generally indicated by reference character 10 that includes a toner developing station 12 in accordance with the present invention.

As seen in the Figures the toning apparatus 10 includes an imaging member 16 having an image bearing surface 18 thereon. In FIGS. 2 and 3 the member 16 is shown as generally cylindrical in configuration while in FIG. 4 (also a highly diagrammatic representation) the imaging member 16 is planar in configuration. Although the toning station 12 is shown in the FIGS. 2 and 3 as being arranged at the six o'clock position as viewed from the side of the imaging member 16 it should be understood that the toning station 12 may be located in any desired location lying from approximately nine o'clock to approximately three o'clock of the member 16.

The imaging member 16 may take the form of, for example, a conductive drum, plate or belt. The surface 18 may be formed from a selenium/tellurium alloy of from a coating of cadmium sulfide or an organic photoconductor. Additionally other materials, such as photopolymer or a silver halide electrostatic master may be used. Optionally this surface may be mounted on a conductive support such as aluminized polyethylene terephthalate which is itself mounted on the imaging member 16. Of course it should be understood that the imaging member 16 and the image bearing surface 18 may be provided by any other suitable alternatives. Drive means, such as that diagrammatically indicated at reference character 20 in FIG. 3, is connected to the shaft 22 of the imaging member 16 and is provided to move the imaging member 16 along a predetermined path of travel generally indicated by the reference arrow 24. A corresponding drive arrangement is indicated in diagrammatic form in FIG. 4 and is appropriately provided for the embodiment of the imaging member 16 shown in that Figure.

The imaging surface 18 of the member 16 is moved past a charging device 26, such as a scorotron, which applies a substantially uniform charge to the surface 18 of the member 16. Thereafter the member 16 is moved to position adjacent an exposure device 30. Any suitable exposure device whereby the surface 18 is imagewise exposed lies within the contemplation of the present invention. Suitable for use as the exposure device 30 is a optical exposure device, a continuous tone or half tone laser exposure device. In some systems the exposure device 30 may precede the charging device 26. As is well known in the electrophotographic arts the charge previously deposited on the surface 18 of the member 16 is discharged in those areas thereof at which the surface 18 is imagewise exposed to imaging radiation. The presence of absence of charge on the surface 18 after the exposure thereof represents an electrostatic latent image of the original image.

Thereafter the imaging member 16 is moved past the toning station 12 embodying the teachings of the present invention. As may be seen in FIGS. 2 and 3 the toning station 12 includes toner tank 40 which holds a liquid toner. The toner tank 40 preferably is generally pyramidal and thus exhibits a V-shaped lower region 42 when viewed in FIGS. 2 and 3. The lower region 42 when so configured assists in the recirculation of the toner and eliminates stagnant zones that are present in U-shaped tanks. The sidewalls of the lower region 42 of the tank 40 should preferably be inclined to allow the toner particles to drain to the apex of the tank 40. The toner tank 40 is conveniently mounted within a framework 43 (as seen in FIG. 3) that is itself supported in any suitable manner within the superstructure of the apparatus 10. The tank 40 is preferably made of metal, such as aluminum or stainless steel. Preferably the tank 40 should be grounded. The liquid toner may be any of the commonly used liquid electrostatic toners, such as that disclosed in U.S. Pat. No. 4,631,244 (Mitchell), assigned to the assignee of the present invention.

Disposed within the toner tank 40 is a toner reservoir 44. The reservoir may be any convenient shape when viewed in side elevation, such as the squared U-shape shown in FIGS. 2 and 4. The reservoir 44 could also be V-shaped in elevation, similar to the configuration of the lower region 42 of the tank 40. The reservoir 44 is supported within the tank 40 by suitable braces 45 which are diagrammatically illustrated in FIGS 2 and 4. The volume of the reservoir 44 is large enough to damp turbulence therein. The transverse dimension 44L (FIG. 3) of the reservoir 44 may extend any convenient distance, dependent upon the size of the apparatus. Typically the distance 44L may be from two to forty-five inches. The toner reservoir 44 is preferably fabricated from an insulating material such as polyvinyl chloride. The material used for the reservoir 44 should not be susceptible to attack by the components of the toner. If the reservoir 44 were manufactured from a conductive material, such as aluminum, the braces 45 should preferably be fabricated of an insulating material.

A toning member 46 in accordance with the present invention is disposed over the open top of the toner reservoir 44. The toning member 46 is supported on the upper edges of the reservoir 44 and is there held in place by any suitable mechanical expedient, such as screws. Preferably the member 46 is removably secured to the reservoir 44. The member 46 should not be secured by any material which may be susceptible to attack by the components of the liquid toner.

Figure 4:
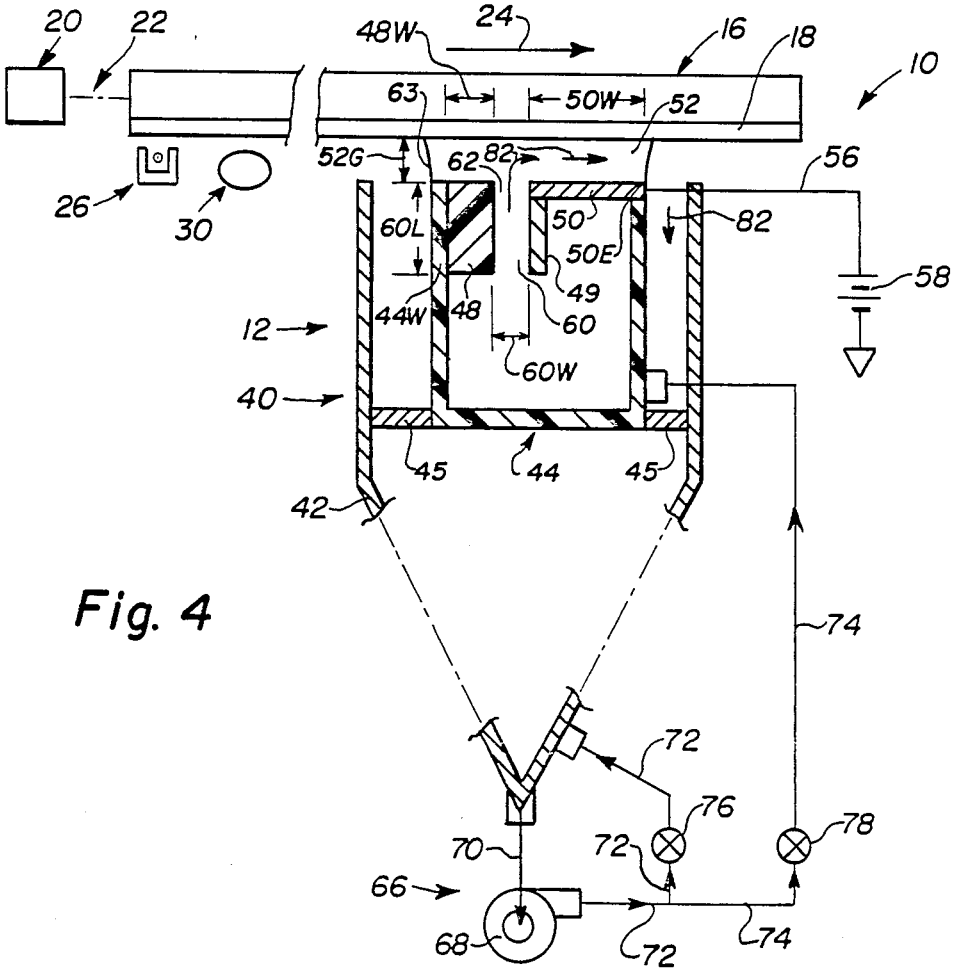
FIG. 4 is a stylized diagrammatic representation in side elevation similar to FIG. 2 illustrating the toning member of the present invention as used with a toning apparatus of the type having a planar imaging member.

As is seen in FIGS. 2 and 4 the toning member 46 is a substantially L-shaped member when viewed in side elevation. The toning member 46 extends transversely across substantially the full transverse dimension of the imaging member 46 and conforms in exterior configuration thereto so as to be cooperable therewith to define a flow channel 52 therebetween. The channel 52 has a gap 52G having a demension in the range 0.02 to 0.06 inches (0.051 to 0.152 cm). Preferably the gap 52G has a dimension on the order of 0.04 inches (0.102 cm). To prevent any impediment to the flow of toner liquid through the channel 52 the gap dimension thereof at the inlet end (i.e., the left hand end in the FIGS. 2 and 4) should be slightly less than the gap dimension at the outlet(i.e., right hand end in those Figures) thereof. As an example, if the gap is 0.04 inches at its inlet end, it should be on the order of 0.044 inches at its outlet end. In the embodiment of FIG. 4 the member 46 may be tiltably adjustable whereby the enlargement in the gap dimension may be provided by imparting a slight tilt (on the order of two to four, and preferably three, degrees to the horizontal) as the member 46 is mounted in FIG. 4.

The toning member 46 comprises a first element 48 and a second element 50. The first element 48 is formed of a nonconductive material, such as polyvinly chloride. The second element 50 of the toning member 46 is formed of a conductive material, such as stainless steel with a polished surface. The surface of the conductive element 50 of the toning member 46 should have a mirror finish. The surface should prefably be polished to a surface roughness of better than 0.060 micron (micrometers) RMS. The second element 50 is connected, e.g., via a screw terminal, over a line 56 to a source 58 of electrical potential, which thereby defines means for imposing a predetermined bias potential (preferably on the order of zero to two hundred volts DC) on the conductive element 50.

As will be further explained herein the relative width dimensions 48W, 50W of the nonconductive element 48 and the conductive element 50 (as measured in the direction of motion of the imaging member 16 along the path of travel 24) respectively serve to define the regions of the channel 52 over which respectively occurs unbiased and biased toning of the imaging surface 18 of the imaging member 16. The minimum dimension 50W for the conductive element is preferably one-half (0.50) inch. This dimension can extend to any convenient dimension. Similarly the minimum dimension 48W for the nonconductive element is preferably one-quarter (0.25) inch it may also extend to any convenient dimension. The dimensions 48W, 50W should be of sufficient length to provide adequate toning area in order to achieve toning to completion. Due to the nature of the materials forming the first element 48 and the second element 50 and the bias means 56, 58 toning in the presence of a bias potential occurs only in the region of the channel 52 adjacent the conductive element 50. The edge 50E of the conductive element 50 at the outlet end (i.e., right hand end in FIGS. 2 and 4) is preferably very sharp, thereby to provide an abrupt dropoff for the toner and a sharply defined end of the electric field produced by the bias potential.

The first element 48 of the toning member 46 cooperates with a portion 44W of the sidewall of the reservoir 44 to form a channel 60 that terminates in an orifice 62. The orifice 62 communicates with the flow channel 52. If the reservoir 44 was fabricated of a conductive material at least the portion 44W of the reservoir should be nonconductive. The channel 60 should be bounded by nonconductive surfaces. In FIG. 2 the orifice 62 is disposed upstream in the direction of the movement of the imaging member 16 from the first nonconductive element 48. In FIG. 4 an alternate arrangement is illustrated in which the orifice 62 is disposed intermediate the first element 48 and the second element 50. In this embodiment the nonconductive member 48 is attached, as by screws, to the sidewall 44W of the reservoir 44. In this configuration an additional leg 49 should be connected (as by screws) to the conductive member 50 to define the channel 60. The leg 49 should be made of a nonconductive material. In both embodiments toner liquid forms a pool or meniscus 63 over the toning member 46.

The width dimension 60W of the channel 60 is less than its length dimesion 60L. This relationship is necessary to provide laminar flow of the toner through the channel 52. The width dimension 60W is adjustable. The ratio of the width to the length is in the range 2:100 to 6:100. Preferably the width 60W of the channel 60 is on the order of less than 0.0625 inches (0.1588 cm) and its length 60L is on the order of two inches (5.08 cm). It is, of course, understood that the drawings are diagrammatic in form and are thus not to scale. The relationship of the dimensions of the channel 60 prevents eddies from forming and interrupting a laminar flow of toner to and over the toning member 46. Of course, as used herein whenever dimensions are given they are intended only for illustration and are to construed in an illustrative and not in a limiting sense. Any structural embodiment which imparts the functions described herein lies within the contemplation of this invention.

Means generally indicated at 66 are provided for maintaining the toner in the reservoir 44 in a deflocculated state and for circulating the toner to the reservoir 44 and back to the tank 40. The means 66 includes a variable speed centrifugal pump 68 such as that manufactured by Gelber Pumps Inc., Newark, Delware and sold as model MDXT-3. A gear pump from the same manufacturer sold as model 130-415 may be alternatively used. The suction side of the pump 68 is supplied over a line 70 from the apex of the V-shaped toner tank 40. The pressurized output of the pump 68 is conveyed via a first line 72 and a second line 74 branching from the first line 72 to the tank 40 and the reservoir 44, respectively. Each line 72, 74 is provided with a metering valve 76, 78, respectively to control the toner flow rate. Suitable for use as the valves 76, 78 are those manufactured and sold by Whitey Company, Highland Heights, Ohio as model SS83TF4. Toner draining from the tank 40 is recirculated thereto when the apparatus 10 is not in use. The line 74 is attached to the reservoir 44 via a flexible and removable connection. The line 72 could, if desired, feed into the tank 40 via two or more ports to enhance the agitation of the toner in the tank 40. The tubing for the lines 70, 72 and 74 should be made of a material that is not susceptible to attack by the components of the toner.

When the toning station 12 is in use the liquid toner flows from the toner tank 40 to the toner reservoir 44 via the line 70, the pump 68, the line 72 and the line 74 branching therefrom. The toner then flows from the reservoir 44, through the capillary channel 60 and from the orifice 62 into the channel 52 and over the toning member 46. The speed of the pump should be adjusted to conform to the transverse dimension of the toning member 46 and to provide the desired flow rate of toner over the toning member 46. For an eight inch transverse width member 46 and a flow rate of approximately one inch per second the pump speed should be seven hundred milliliters per second (700 ml/sec.).

As shown by the direction arrows 82 the flow of toner is in the direction of travel of the imaging member 16. The flow over the conductive element 50 of the toning member 46 must be laminar. The design of the toning station 12 is such that it prevents eddies being formed in the toner supplied to the channel 52 and over the conductive element 50 of the toning member 46 which would cause defects in the toned image on the imaging member 16. Irregularities in the conductive element 50 of the member 46 will affect laminar flow through the channel 52. It has been found that the relative motion (flow rate) between the imaging member 16 and the liquid toner flowing over the toning member 46 should be less than five inches per second (12.7 cm/sec.) and should preferably be less than two inches per second (5.08 cm/sec.) to prevent turbulence which could cause toning defects.

Figure 5:
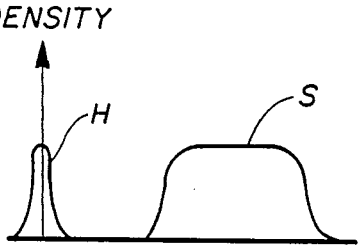
FIG. 5 is a graphical illustration generally similar to FIG. 1C which depicts the density distribution of toner when the highlight and the shadow image dots have been toned using the method and apparatus in according with the present invention.

FIG. 5 shows the density of the toned image using the method and the apparatus of the present invention in which toning of the image bearing surface 18 is accomplished in the absence of a bias voltage in the region of the channel 52 in the vicinity of the first, nonconductive, element 48 and in the presence of a biasing voltage only in the region of the channel 52 adjacent to the second, conductive, element 50. In the nonbias/bias toning process and apparatus of the present invention smaller image dots have the opportunity to tone to completion because of the larger electric driving force. Apparently the same condition is experienced by the edges of the shadow image dots. Following unbiased toning the bias toning process removes the excess toner from the background area and the excess toner in the fringe field areas and completes the toning in the shadow dot areas. The net result is that the average density in the smaller highlight image dot H is comparable to that in the shadow image dot S. Highlight image information can therefore be retained after toning. As an example, for a half tone image (with a 150 line screen) a bias toning process cannot resolve dots smaller than a two percent dot, especially in a high speed toning process. The nonbias/bias toning process of this invention solves this problem and results in high quality images with sharp edges.

It is important that the biased conductive element 50 defines the last region of the channel 52 over which toning occurs. Thus although it lies within the contemplation of the present invention that other configurations for the toning member 46 may be used in which, for example, a third element of the toning member 46 is provided, it should be understood that the biased conductive element 50 should be the last occurring of the elements and disposed just prior to the end of the toning station 12. That is, the imaging member 16 leaving the zone of the toning station 12 should be last influenced by the conductive element 50 of the member 46.

Although the Figures illustrate only one toning station 12 in association with an imaging member 16 it should be understood that two or more toning stations, each as described above, may be used in association with either a cylindrical or planar imaging member. Each such toning station may utilize liquid toner of a different color.

Those skilled in the art having the benefit of the teachings of the present invention may impart numerous modifications thereto. It is to be understood that these modifications are to be construed as lying within the contemplation of the present invention as defined by the appended claims.

What is claimed is:

1. In an electrostatic toning apparatus of the type using a liquid toner, the apparatus having a reservoir for a liquid toner;

an imaging member having an image bearing surface thereon;

means for moving the imaging member along a predetermined path of travel past the reservoir, a toning station having a toning member therein, the toning member being mounted in proximity to the path of travel of the imaging member and cooperating therewith to define a channel therebetween, the channel being in fluid communication with the reservoir, and means for pumping the liquid toner into the channel and flowing the same over the toning member such that the toner may be brought into contact with the image bearing surface thereby to develop a latent image carried on the same.

wherein the improvement comprises:

the toning member having a first and a second element which cooperate to define regions of the channel over which toning of the image bearing surface occurs, the first element being disposed upstream from the second element along the path of travel of the imaging member so that the second element defines the last region of the channel over which toning occurs, the first element being formed of a nonconductive material while the second element is formed of a conductive material:

means for forming a laminar flow of toner liquid in the channel over the second element of the toning member; and means for imposing a predetermined bias potential on the second element such that, as the imaging member is moved past the toning member, toner in the channel is brought into toning contact with the image bearing surface first in the absence of a bias potential in the region of the channel adjacent to the first element and then in the presence of a bias potential only in the region of the channel adjacent the second element of the toning member.

2. The toning apparatus of claim 1 wherein the imaging member is planar.

3. The toning apparatus of claim 1 wherein the imaging member is cylindrical.

4. The toning apparatus of claim 1 wherein the improvement further comprises means for forming a laminar flow of toner liquid in the channel over the second element of the toning member.

5. The toning apparatus of claim 2 wherein the channel communicaties with the reservoir through an orifice and wherein the improvement further comprises the orifice being disposed upstream of the first element of the toning member along the path of travel of the imaging member.

6. The toning apparatus of claim 3 wherein the channel communicates with the reservoir through an orifice and wherein the improvement further comprises the orifice being disposed upstream of the first element of the toning member along the path of travel of the imaging member.

7. The toning apparatus of claim 4 wherein the channel communicates with the reservoir through an orifice and wherein the improvement further comprises the orifice being disposed upstream of the first element of the toning member along the path of travel of the imaging member.

8. The toning apparatus of claim 2 wherein the channel communicates with the reservoir through an orifice and wherein the improvement further comprises the orifice being disposed intermediate the first and the second elements of the toning member.

9. The toning apparatus of claim 3 wherein the channel communicates with the reservoir through an orifice and wherein the improvement further comprises the orifice being disposed intermediate the first and the second elements of the toning member.

10. The toning apparatus of claim 4 wherein the channel communicates with the reservoir through an orifice and wherein the improvement further comprises the orifice being disposed intermediate the first and the second elements of the toning member.

11. A method of developing a latent electrostatic image carried on an image bearing surface of an imaging member comprising the steps of:

(a) moving the image bearing surface past a toning member having a first nonconductive and a second conductive element thereon, the surface and the toning member defining a channel therebetween, the first and the second elements respectively defining the first and last regions of the channel over which toning of the surface occurs, (b) flowing a liquid toner into the channel and over the toning member so that the flow of toner over the conductive element is a laminar flow and so that the toner contacts the image bearing surface to develop the latent image on the image bearing surface as the same moves past the toning member, (c) imposing a predetermined bias potential on the conductive element of the toning member such that the toner contacts the image bearing surface first in the absence of a bias potential in the region of the channel adjacent to the first element and then in the presence of a bias potential only in the region of the channel adjacent the conductive element of the toning member.

12. The method of claim 11 wherein the flow of toner over the conductive element of the toning member is a laminar flow.

* * * * *